US010480465B2

(12) United States Patent
Heaps et al.

(10) Patent No.: US 10,480,465 B2
(45) Date of Patent: Nov. 19, 2019

(54) VACUUM PUMP AND SYSTEM OF A VACUUM PUMP AND AN ENGINE

(71) Applicant: WABCO Europe BVBA, Brussels (BE)

(72) Inventors: David Heaps, Haworth (GB); Phillip Saxton, Morley Leeds (GB); Peter Todman, Upper Poppleton York (GB)

(73) Assignee: WABCO EUROPE BVBA, Brussels (BE)

( * ) Notice: Subject to any disclaimer, the term of this patent is extended or adjusted under 35 U.S.C. 154(b) by 220 days.

(21) Appl. No.: 15/306,108

(22) PCT Filed: Apr. 30, 2015

(86) PCT No.: PCT/EP2015/000886
§ 371 (c)(1),
(2) Date: Oct. 24, 2016

(87) PCT Pub. No.: WO2015/185177
PCT Pub. Date: Dec. 10, 2015

(65) Prior Publication Data

US 2017/0058846 A1 Mar. 2, 2017

(30) Foreign Application Priority Data

Jun. 5, 2014 (EP) ..... 14001948.0

(51) Int. Cl.
*F02M 35/10* (2006.01)
*F04C 25/02* (2006.01)
(Continued)

(52) U.S. Cl.
CPC ... *F02M 35/10229* (2013.01); *F04C 18/3441* (2013.01); *F04C 25/02* (2013.01);
(Continued)

(58) Field of Classification Search
CPC ..... F01C 21/0881; F02M 35/10229; F04C 18/3441; F04C 25/02; F04C 27/009;
(Continued)

(56) References Cited

U.S. PATENT DOCUMENTS 2,000,925 A * 5/1935 Cowles ..... F16N 27/00 184/7.4
4,539,959 A * 9/1985 Williams ..... F02M 55/02 123/198 DB (Continued)

FOREIGN PATENT DOCUMENTS

CN 101120174 A 2/2008
CN 101421518 A 4/2009

(Continued)

*Primary Examiner* — Patrick Hamo
*Assistant Examiner* — Joseph S. Herrmann
(74) *Attorney, Agent, or Firm* — Leydig, Voit & Mayer, Ltd.

(57) ABSTRACT

A vacuum pump suitable for mounting to an engine includes a casing, a cavity in the casing having with an inlet and an outlet, a moveable member arranged for rotation inside the cavity, wherein the movable member is movable to draw fluid into the cavity through the inlet and out of the cavity through the outlet so as to induce a reduction in pressure at the inlet, an oil supply conduit for supplying oil from a reservoir to the cavity, and a check valve having a check valve body arranged in the oil supply conduit. The check valve meters the oil flow to the cavity dependent on an oil pressure so that on exceeding an upper oil pressure threshold the supply of oil to the cavity is stopped by means of the check valve.

20 Claims, 8 Drawing Sheets

(51) Int. Cl.
*F04C 27/00* (2006.01)
*F04C 29/02* (2006.01)
*F04C 18/344* (2006.01)
*F04C 29/00* (2006.01)

(52) U.S. Cl.
CPC ..... *F04C 27/009* (2013.01); *F04C 29/0007* (2013.01); *F04C 29/0057* (2013.01); *F04C 29/021* (2013.01); *F04C 29/028* (2013.01); *F04C 2240/30* (2013.01)

(58) Field of Classification Search
CPC ..... F04C 29/0007; F04C 29/0057; F04C 29/021; F04C 29/028; F04C 29/124; F04C 29/126; F04C 2240/30; Y10T 137/7785
See application file for complete search history.

(56) References Cited

U.S. PATENT DOCUMENTS 5,062,448 A * 11/1991 Hilsenbeck ..... F16K 17/26 137/498
5,336,166 A * 8/1994 Sierra ..... A61M 27/006 137/498
6,190,149 B1 * 2/2001 Richman ..... F04C 29/025 418/188
6,196,640 B1 3/2001 Stender
6,287,099 B1 9/2001 Chang, II et al.
8,628,317 B2 * 1/2014 Heaps ..... F04C 18/3442 417/364
2003/0063991 A1 * 4/2003 Toyama ..... F01C 21/0872 418/93
2004/0148085 A1 7/2004 Heuer
2004/0183372 A1 9/2004 Heuer et al.
2005/0011693 A1 1/2005 Horn et al.
2008/0101975 A1 5/2008 Kishi et al.
2008/0232981 A1 * 9/2008 Zhou ..... F04C 18/3442 417/284
2010/0239440 A1 * 9/2010 Heaps ..... F04C 18/3442 417/364
2010/0304929 A1 12/2010 Hilberer
2010/0326124 A1 * 12/2010 Takahashi ..... F04C 18/356 62/468

FOREIGN PATENT DOCUMENTS

CN 101910563 A 12/2010
DE 3906823 A1 7/1990
DE 10144299 A1 6/2003
DE 20315755 U1 12/2003
DE 10311838 A1 10/2004
DE 102004036089 A1 2/2006
DE 102006016241 A1 10/2007
DE 102007023345 A1 11/2008
DE 102009031851 A1 1/2011
DE 102010019433 A1 11/2011
EP 0406800 B1 1/1991
EP 0597732 A1 5/1994
EP 0914998 B1 5/1999
EP 1167141 B1 1/2002
EP 1439103 A1 7/2004
EP 1972785 B1 9/2008
EP 2384941 A1 11/2011
EP 2664506 A1 11/2013
JP S 5529066 A 3/1980
JP H 02218885 A 8/1990
JP H 07119665 A 5/1995
JP 2004011421 A 1/2004
JP 2008157070 A 7/2008
WO WO 2007116216 A1 10/2007
WO WO 2007139488 A1 12/2007
WO WO 2010145634 A2 12/2010
WO WO 2013004315 A1 1/2013

* cited by examiner

VACUUM PUMP AND SYSTEM OF A VACUUM PUMP AND AN ENGINE

CROSS REFERENCE TO RELATED APPLICATIONS

This application is a U.S. National Phase application under 35 U.S.C. § 371 of International Application No. PCT/EP2015/000886 filed on Apr. 30, 2015, and claims benefit to European Patent Application No. EP 14001948.0, filed Jun. 5, 2014. The International Application was published on Dec. 10, 2015 as WO 2015/185177 A1 under PCT Article 21(2).

FIELD

The present invention relates to a vacuum pump, and particularly to an automotive vacuum pump and a system comprising an engine and a vacuum pump.

BACKGROUND

Vacuum pumps may be fitted to road vehicles with gasoline or diesel engines. Typically, the vacuum pump is driven by a camshaft of the engine. Therefore, in most vehicles the vacuum pump is mounted to an upper region of the engine. But other configurations where the vacuum pump is mounted to a lower region of the engine are known. In general, two different construction types of vacuum pumps are known, one is the type incorporating a movable piston, and the other is vane pump. Nowadays, vane pumps are frequently utilized.

A vane pump of the aforementioned type typically comprises a casing having a cavity and a movable member arranged for rotation inside the cavity, wherein the cavity is provided with an inlet and an outlet and a movable member is movable to draw fluid into the cavity through the inlet and out of the cavity through the outlet so as to induce a reduction in pressure at the inlet. The inlet is connectable to a consumer such as a brake booster or the like. The outlet normally is connected to the engine's crankcase. Furthermore, the vacuum pumps of the aforementioned type also comprise an oil supply conduit for supplying oil from the engines lubrication circuit to the vacuum pump and a check valve having a check valve body arranged in the oil supply conduit.

Such a vacuum pump, for example, is disclosed in WO 2007/116 216. The disclosed vacuum pump comprises a check valve which is arranged in an oil supply conduit to prevent the flow of oil to the cavity during periods when the pump is not operating. When the pump is not operating it is possible that oil drains by means of gravity into the cavity or is drawn into the gravity by a residual vacuum inside the cavity. The check valve known from WO 2007/116 216 A1 prevents oil from flowing into the cavity.

However, it can also happen that during operation too much oil is supplied to the cavity. Excess oil inside the cavity leads to inefficient operation of the vacuum pump and increases the vacuum pump power consumption. Therefore, arrangements have been developed which meter or dose the oil flow to the cavity. For example, EP 1 972 785 B1 suggests providing a slidably supported valve member inside the check valve which is slidable in a direction perpendicular to a rotational axis of the shaft of the vacuum pump. The slidably supported valve member is arranged in such a way that rotational speed of the shaft the oil supply conduit is more open so that more oil is supplied to the cavity.

From EP 0 406 800 B1 a vacuum vane pump is known which incorporates dosing the oil flow dependent on rotational speed of a vane pump. The disclosed vane pump comprises a first groove in fluid connection with an oil supply conduit and arranged adjacent to the shaft of the vane pump inside the housing, a through bore perpendicular to the rotational axis of the shaft provided in the shaft and a second groove in fluid communication with the cavity and arranged adjacent to the shaft of the vane pump inside the housing. The through bore is arranged in such a way that on rotation it connects the first with the second groove thus allowing oil flow from the oil supply conduit to the cavity. Further, EP 0 406 800 B1 discloses one or two spherical valve elements inside the through bore to measure or dose the oil flow in such a way that e.g. on every rotation an amount of oil equal to the volume of the through bore is supplied to the cavity.

SUMMARY

In an embodiment, the present invention provides a vacuum pump suitable for mounting to an engine. The vacuum pump includes a casing, a cavity in the casing having with an inlet and an outlet, a moveable member arranged for rotation inside the cavity, wherein the movable member is movable to draw fluid into the cavity through the inlet and out of the cavity through the outlet so as to induce a reduction in pressure at the inlet, an oil supply conduit for supplying oil from a reservoir to the cavity, and a check valve having a check valve body arranged in the oil supply conduit. The check valve meters the oil flow to the cavity dependent on an oil pressure so that on exceeding an upper oil pressure threshold the supply of oil to the cavity is stopped by means of the check valve.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
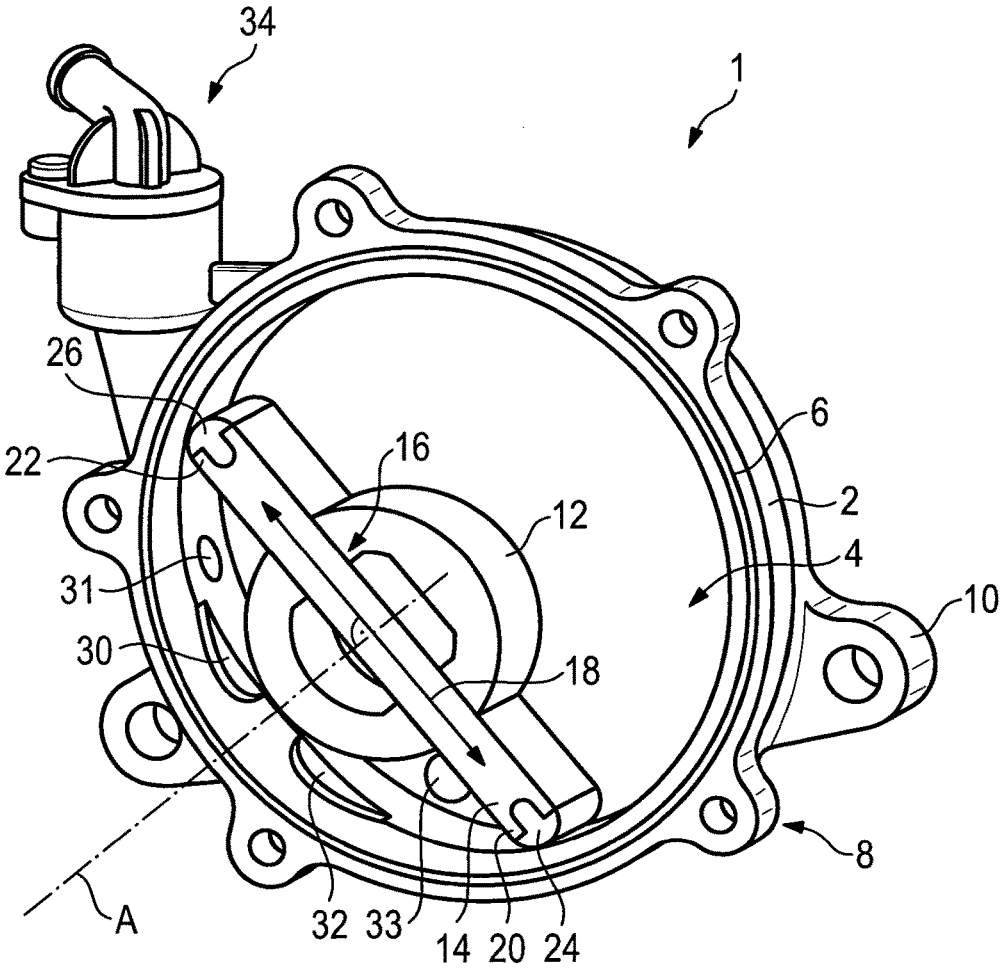
FIG. 1 shows a perspective view of an open vacuum pump according to an embodiment of the present invention.

A drawback of known vacuum pumps is even though some are able to dose the oil flow to the cavity, an excess oil flow to the cavity cannot be effectively prevented. A vacuum pump of which prohibits an excess oil flow to the cavity is described herein. A system is described herein that comprises an engine and a vacuum pump, wherein the vacuum pump is mounted to the engine, in particular wherein the vacuum pump is driven by a camshaft of the engine, in particular an engine of a road vehicle.

A vacuum pump suitable for mounting to an engine is described herein that includes a casing having a cavity and a moveable member arranged for rotation inside the cavity, wherein the cavity is provided with an inlet and an outlet and the movable member is movable to draw fluid into the cavity through the inlet and out of the cavity through the outlet so as to induce a reduction in pressure at the inlet, further comprising an oil supply conduit for supplying oil from a reservoir to the cavity and a check valve having a check valve body arranged in the oil supply conduit.

In an embodiment of the invention, a check valve meters oil flow to the cavity dependent on the oil pressure so that on exceeding an upper oil pressure threshold the supply of oil to the cavity is stopped by means of the check valve.

Oil as used herein can include lubrication liquid more broadly. A fluid as used herein can define any kind of fluid to be pumped, in particular a gaseous fluid or gas, including air, etc. The term oil pressure as used herein can define the pressure of oil measured between the oil reservoir side and the cavity side of the check valve. That is, the term "oil pressure" can be used to define the pressure difference between the oil reservoir side and the cavity side of the check valve (i.e. "oil pressure"="pressure at oil reservoir side"−"pressure at cavity side"). Examples for an oil reservoir according to embodiments of the invention are an engine lubrication circuit or an oil gallery of the engine.

The upper oil pressure threshold is preferably predetermined. Thus on exceeding the upper oil pressure threshold the check valve will close and therefore prohibiting oil to enter the cavity on a too high oil pressure level leading to an extensive oil flow to the cavity. Since in the cavity a vacuum is present the pressure inside the cavity is lower than standard pressure. The pressure measured between the oil reservoir side and the cavity side of the check valve normally will be higher than a pressure measured between the oil reservoir side of the check valve and the standard pressure. Additionally, when the check valve closes on exceeding the upper oil pressure threshold, the oil reservoir pressure may directly by applied to a main bearing, in particular main friction bearing, of the vacuum pump. This additional oil pressure on the main bearing supplements the hydro-dynamically generated bearing pressure and significantly reduces the low speed power consumption of the vacuum pump.

According to a first preferred embodiment, the check valve meters the oil flow to the cavity dependent on the oil pressure measured between the oil reservoir side and the cavity side of the check valve so that on falling below a lower oil pressure threshold the oil flow is stopped by means of the check valve. This prevents oil from draining or flowing into the cavity when the vacuum pump is not operating. Again oil pressure relates to the pressure between the check valve and the cavity.

Particularly preferred is that the check valve body is movable between a first closed position, an open position and a second closed position, and the check valve body is located in the first closed position when the oil pressure is lower than a lower oil pressure threshold, in the open position, when the oil pressure is between a lower oil pressure threshold and an upper oil pressure threshold and in the second closed position when the oil pressure exceeds the upper oil pressure threshold. The both closed positions, namely the first closed position and the second closed position can be spatially separated or be identical. Therefore when starting from a zero (or even a negative) oil pressure, the check valve body of the check valve is located in the first close position. No oil flow from the oil supply conduit to the cavity is allowed. When the oil pressure (measured between the oil reservoir side and the cavity side of the check valve) rises above the lower oil pressure threshold, the check valve body moves from the first closed position into the open position, thus allowing oil to flow from the oil supply conduit to the cavity. During operation the oil pressure may further rise until it exceeds an upper oil pressure threshold. The check valve body then moves further to the second closed position and is being located in the second closed position, when the oil pressure exceeds the upper oil pressure threshold. Then again the check valve is closed and an oil flow from the oil supply conduit to the cavity is prohibited.

It is further preferred that the check valve comprises first and a second valve seats for engagement with the check valve body. Preferably the check valve body engages the first valve seat in the first closed position and the check valve body engages the second valve seat in the second closed position. Again the valve seats may be spatially separated or identical. If the both valve seats are separated, preferably the second valve seat is arranged downstream of the first valve seat in a direction of the oil flow to the cavity. This leads to a simple and compact design of the check valve.

According to a further preferred embodiment a biasing member is arranged in the check valve to bias the check valve body in the first closed position. Thus the biasing member is adapted to bias the check valve body to the first valve seat. The biasing member has a biasing force. A biasing force is used to adjust the lower oil pressure threshold. The check valve body has to be moved from the first closed position against the biasing member and thus against the biasing force from the first closed position into the open position. Preferably the biasing force of the biasing member is used to adjust the upper oil pressure threshold.

In a further preferred embodiment at least one of the two valve seats is formed by a plug having a through hole and arranged in the oil supply conduit. In one alternative the first valve seat is formed by the plug having the through hole and arranged in the oil supply conduit. In another alternative the second valve seat is formed by the plug having the through hole and arranged in the oil supply conduit. In a further alternative both, the first and the second valve seats are formed by a plug having a through hole and arranged in the oil supply conduit. The check valve is arranged in the oil supply conduit. Therefore preferably both valve seats are also arranged in the oil supply conduit. Preferably the check valve body is arranged in a cavity of the check valve movable between the first and the second valve seats. The cavity of the check valve may be formed by a diameter enlarged portion of the oil supply conduit. One of the two valve seats may be then formed by tapered wall connecting the diameter enlarged portion of the oil supply conduit with the oil supply conduit. Preferably the valve seat, which is not formed by the plug is formed by tapered wall connecting the diameter enlarged portion of the oil supply conduit with the oil supply conduit. Thus, in an alternative where for example the second valve seat is formed by the plug, the first valve seat is formed by the tapered wall and vice versa. The diameter increased portion of the oil supply conduit may then extend to the cavity of the pump terminating in an oil inlet to the cavity. According to the present embodiment one of the two valve seats, in particular the second valve seat is then formed by a plug, arranged and preferably fixed in the oil supply conduit at the proximal end of the diameter enlarged portion, seen from the cavity of the pump. The plug may be fixed by means of adhering or screwing means. The plug may be pressed into the oil supply conduit or fixed by welding. Preferably the valve seat formed by the plug is formed by a contact line located around the through hole in the plug. Thus the check valve body can close the oil supply conduit when in contact with the plug. In particular the through hole of the plug connects the oil supply conduit with the cavity, hence forming a fluid connection between the oil supply conduit or the oil reservoir with the cavity of the pump.

The biasing member preferably is a spring, in particular a spiral spring or a spring washer, supported by one of the two valve seats. Particular preferred is the biasing member supported by the plug forming one of the two valve seats. Thus, the biasing member preferably is arranged between the second valve seat, which e.g. is formed by the plug, and the check valve body, biasing the check valve body in the direction of the first closed position thus into the direction of the first valve seat. This leads to a simple and compact design of the check valve. A spiral spring generally has a higher range of spring but a lower force of spring, a spring washer has a lower range of spring, but a higher force of spring. Both types of springs can advantageously be used according to the invention.

Preferably the check valve body is formed as a ball or a pintle. When the check valve body is formed as a ball, the use of a spiral spring is advantageous, in the other case where the check valve body is formed as a pintle, the use of a spring washer is preferred although also a spiral spring can be used in a beneficial way.

Further for the vacuum pump, the pump may comprise a drive shaft for rotationally driving the moveable member and preferably the oil supply conduit extends through the drive shaft. Such a shaft could be connected to or may be formed integral with a rotor. The rotor may comprise a slot for engaging with the vane for rotation inside the cavity. Alternatively the oil supply conduit extends through a portion of the housing of the cavity and terminates at an cavity inlet.

Preferably the oil supply conduit comprises an axial portion extending along a rotational axis of the shaft and in fluid communication with the oil reservoir and the cavity respectively. Thus the proximal portion or the end portion of the oil supply conduit with respect to the cavity of the pump runs substantially through the center of the drive shaft and terminates at the cavity. Preferably the oil supply conduit terminates into the slot of the rotor to supply oil to the slot. This leads to a beneficial lubrication of the slit in which the vane moves back and forth during the operation of the pump. Further when arranging the oil supply conduit along a central rotational axis of the shaft, the oil inside the oil supply conduit is not subjected to any centrifugal forces circumferential rotation of the shaft. The oil supply conduit further preferably comprises a radial portion extending from a circumferential face of the shaft to the rotational axis of the shaft and in fluid communication with the axial portion of the oil supply conduit. Preferably the radial portion connects the axial portion of the oil supply conduit with the oil reservoir. It is not essential that the radial portion of the oil supply conduit extends strictly radial, i.e. perpendicular to the rotational axis of the shaft, but more this embodiment relate to the radial portion of the oil supply conduit connecting the axial portion of the oil supply conduit with a radial outer face of the shaft. Thus, the distal axial end of the shaft with respect to the cavity of the pump is free of oil inlets or outlets and can be used as an engaging portion to engage with a camshaft of an engine or with a driving motor or the like.

According to these embodiments, preferably the check valve is arranged in the axial portion of the oil supply conduit. In particular, the axial portion of the oil supply conduit is formed as a cylindrical wall, and the wall of the conduit forming a housing for the check valve. Therefore again the check valve is free of centrifugal forces, since it is arranged with its central axis along the rotational axis of the shaft of the pump.

In a further preferred embodiment the radial portion of the oil supply conduit is in fluid communication with an oil gallery. The oil gallery preferably feeds oil into the cavity of the pump. Preferably the oil gallery is defined between the shaft and the casing of the pump. It may be defined by a circumferential groove in the casing and/or the drive shaft. Thus an operation the radial portion of the oil supply conduit is permanently in fluid communication with the oil gallery. According to such an embodiment, the oil gallery forms a part of a main friction bearing of the drive shaft. When the check valve closes on exceeding the upper oil pressure threshold, the oil reservoir pressure is directly and fully applied to this main friction bearing of the vacuum pump. This additional oil pressure supplements the hydro-dynamically generated bearing pressure and significantly reduces the low speed power consumption of the vacuum pump.

Referring to the drawing in FIG. 1 there is shown a vacuum pump, generally designated 1, which is intended to be located adjacent to an automotive engine. The vacuum pump 1 comprises a casing 2 enclosing a cavity 4. The casing 2 is shown without cover plate thus leaving the view open to the inside cavity 4 of the vacuum pump 1. The cover plate can be attached to the rim 6 of the casing 2 by means of the fixing portions 8 (only one depicted with a reference sign in FIG. 1). Further the casing includes engine fixing portions 10 (only one depicted with a reference sign) for fixing the vacuum pump 1 to an engine.

Within the cavity 4 there is provided a rotor 12 and a vane 14. The vane 14 is slidingly mounted in a slit 16 of the rotor 12 and is slidable movable relative to the rotor 12 as indicated by the arrow 18. The ends 20, 22 of the vane 14 are provided with seals 24, 26 which ensure that a substantially fluid tight seal is maintained between the vane 14 and the wall 28 of the cavity 4.

The cavity 4 is provided with an inlet 31 and an outlet 33. Additionally first and second bypass ports 30, 32 are provided at the cavity 4 to lower cold start torque The inlet 31 is connected to a connector 34 which in turn may be connected to a brake booster arrangement of a vehicle (not shown). The cavity outlet 33 may be connected to the exterior of the pump 1 and may be connected to a crankcase chamber of the engine.

Figure 2:
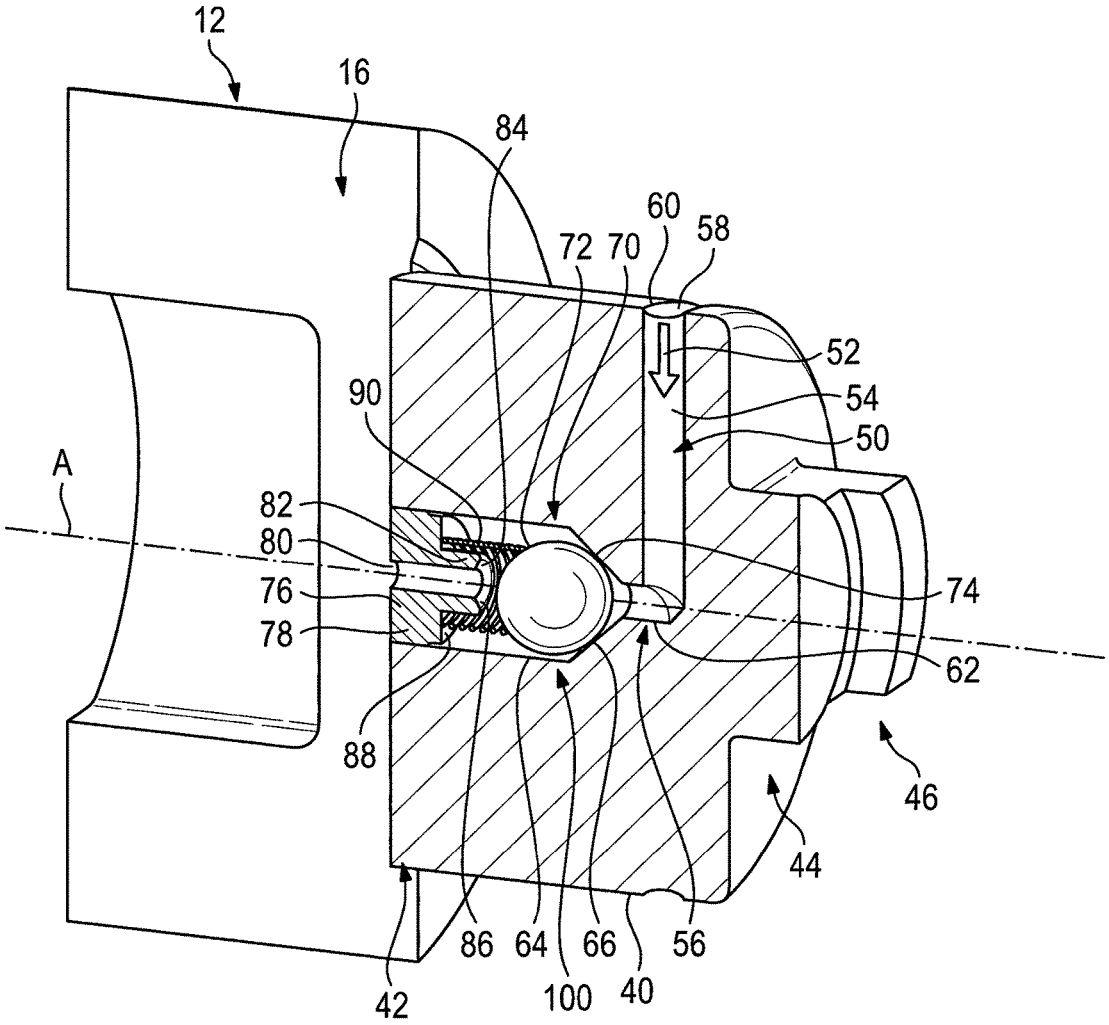
FIG. 2 shows a cross-sectional view of a drive shaft connected to a rotor and a check valve inside the drive shaft according to an embodiment of the present invention.

As to FIG. 2, the rotor 12 is connected to a shaft 40. The shaft 40 comprises a proximal end 42 connected to the rotor 12 and a distal end 44 which includes an engagement section 46 for engaging for example a cam shaft of an engine or any other drive motor. The shaft 40 further comprises an oil supply conduit 50 which runs through the shaft connecting the cavity 4 with an oil reservoir (not shown), which in most cases would be an engine lubrication circuit or an oil gallery. The direction of oil flow from the reservoir (not shown) to the cavity 4 (see FIG. 1) is indicated by arrow 52. The oil supply conduit 50 comprises a radial portion 54 and an axial portion 56. The radial portion 54 extends from the axial portion 56 to the outer radial surface of the shaft 40 joining a circumferential groove 58 on the outer surface of the shaft 40. The circumferential groove 58 forming an oil gallery. Thus the oil gallery formed by the groove 58 is in fluid communication with the inlet 60 of the oil supply conduit 50. The axial portion 56 of the oil supply conduit 50 runs along the rotational axis A of the shaft 40 and the rotor 12. The axial portion 56 of the oil supply conduit 50 comprises a distal portion 62 having substantially the same diameter as the radial portion 54 of the oil supply conduit and a diameter enlarged portion. The diameter enlarged portion 64 is connected to the distal portion 62 by a tapered portion 66. The diameter enlarged portion 64 forms a housing for a check valve 70.

The check valve 70 comprises a check valve body 72. The check valve 72 is according to this embodiment (FIGS. 2 to 3C) formed as a spherical ball. The check valve 70 and thus the check valve body 72 are arranged inside the oil supply conduit 50, the check valve body 72 is arranged inside the diameter enlarged portion 64 of the axial portion 56. According to FIG. 2 the check valve body 72 is located in the first closed position 100. The check valve body 72 is in contact with the tapered portion 66 of the oil supply conduit 50 thus forming a first valve seat 74.

At the proximal end of the axial portion 56 of the oil supply conduit 50 with respect to the cavity 4 a plug 76 is provided. The plug 76 comprises a plug body 78 and a through hole 80, the through hole 80 connecting the oil supply conduit 50 with the cavity 4. The plug body 78 has an outer dimension adapted to be fixed inside the oil supply conduit 50 namely according to this embodiment inside the diameter enlarged portion 64. The central axis of the through hole 80 is substantially arranged along the rotational axis A of the shaft 40 and the central axis of the axial portion 56 of the oil supply conduit 50. The plug body 78 further includes a central protrusion 82 protruding from the plug body 78 basically along the rotational axis A of the shaft into the direction of the distal end 44 of the shaft 40 and thus into the direction of the first valve seat 74. The protrusion 82 has a generally cylindrical shape and the through hole 80 generally runs centrally through the protrusion 82 terminating at the top end 84 of the protrusion 82. At the top end 84 the protrusion 82 includes an inwardly sloped surface 86 adapted to engage with the check valve body 72. The plug 76, in particular the sloped surface 86 of the protrusion 82 forms a second valve seat (87; see FIG. 3B). The plug body 78 further has a supporting surface 88 running substantially around the protrusion 82 and arranged substantially perpendicular to the central axis of the through hole 80. The surface 88 serves as a support for the spiral spring 90 forming a biasing member according to this embodiment. The spiral spring 90 is on the first end (on the left side of FIG. 2) in contact with the supporting surface 88 and on the second end (on the right side of FIG. 2) in contact with the check valve body 72 to bias the check valve body 72 against the first valve seat 74 and thus into the first closed position 100.

The working principle of the check valve 70 will now be described in detail with reference to FIG. 3A, FIG. 3B and FIG. 3C. Whereas FIG. 3A shows the check valve body 72 in a first closed position 100, FIG. 3B shows the check valve body in an open position 102 and FIG. 3C in the second closed position 104.

Figure 3A:
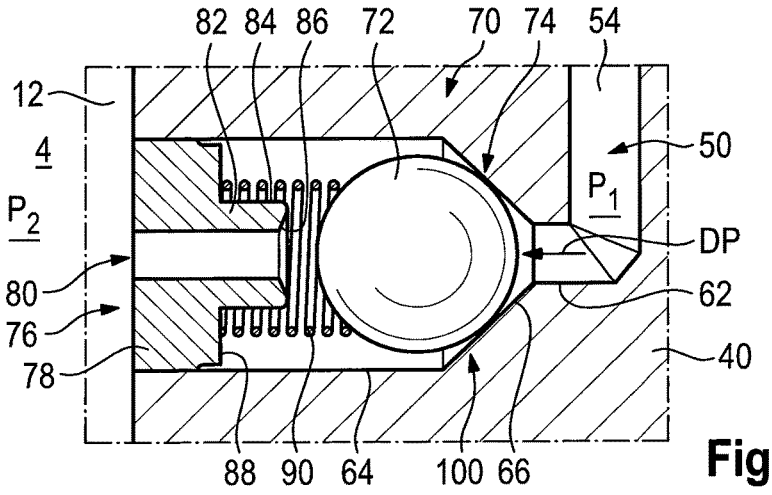
FIGS. 3A-3C show the working principle of the check valve of FIG. 2.

FIG. 3A mainly shows the same situation as FIG. 2. The check valve body 72 is in the first closed position 100 and engages the valve seat 74. The oil supply conduit 50 is closed and no oil can flow from the oil supply conduit 50 into the cavity 4. The spiral spring 90 biases the check valve body 72 against the valve seat 74. The oil pressure DP acting on the check valve body 72 is below a lower oil pressure threshold. The oil pressure DP is defined by the pressure difference P1−P2 between the oil reservoir side and the cavity side of the check valve 70. Thus the force of the spring 90 forcing the check valve body 72 against the valve seat 74 is higher than the force resulting of the pressure DP forcing the check valve body 72 away from the valve seat 74 thus into the direction of the plug 76.

Figure 3B:
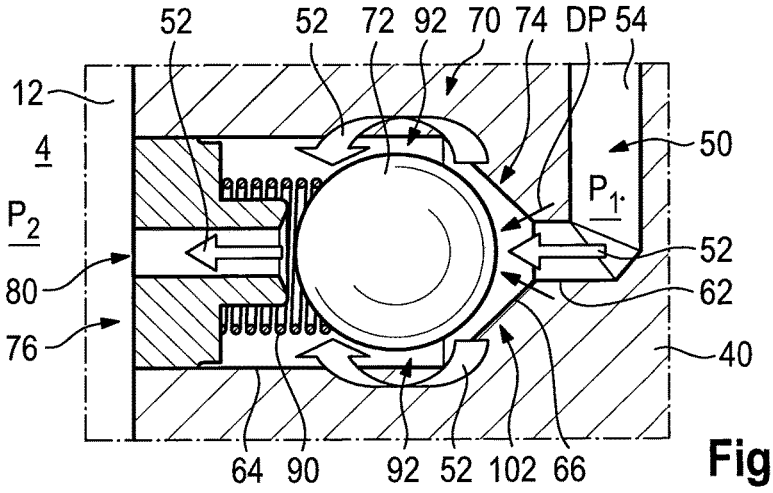

When pressure DP rises and exceeds the lower oil pressure threshold the check valve body 72 moves into an open position 102, as shown in FIG. 3B.

In FIG. 3B the check valve body 72 has moved away and disengaged the valve seat 74 formed by the tapered portion 76. As easily can be seen in the figures, the diameter of the spherical formed check valve body 72 is slightly smaller than the interior diameter of the diameter enlarged portion 64 of the oil supply conduit 50. Therefore, when disengaging from the first valve seat 74 the check valve body 72 leaves a gap 92 between the check valve body 72 and the inner surface of the diameter enlarged portion 64 thus allowing oil 52 to flow from the oil supply conduit 50 into the cavity 4. The oil flows through the radial portion 54, the axial portion 56 around the check valve body 72 and through the through hole 80 formed in the plug 76 until reaching the cavity 4. In this open position 102 (see FIG. 3B) the spiral spring 90 is compressed to a certain extend but not fully compressed. The spring force which is equivalent to the range the spring is compressed and therefore equivalent to the way the check valve body 72 moves from the first closed position 100 (FIG. 3A) to the open position 102 (FIG. 3B) substantially corresponds to the pressure DP measured as the difference of the pressure P1 at the oil reservoir side and the pressure P2 measured at the cavity side of the check valve 70 (DP=P1−P2) and acting on the check valve body 72.

When the oil pressure P1 inside the oil supply conduit 50 rises further (see FIG. 3C) and thus the oil pressure DP rises accordingly, the spring 90 is being compressed further until the check valve body 72 engages the second valve seat 87 formed by the sloped surface 86 of the protrusion 82. In this second closed position 104 (see FIG. 3C) the check valve body 72 closes the through hole 80 of the plug 76 and oil flow into the cavity 4 is thus stopped. The arrows 53 in FIG. 3C depict oil, which may flow beneath and behind the check valve body 72, however does not enter the cavity 4. Thus when the oil pressure DP exceeds an upper oil pressure threshold the supply of oil to the cavity 4 is stopped by the check valve 70.

Figure 3C:
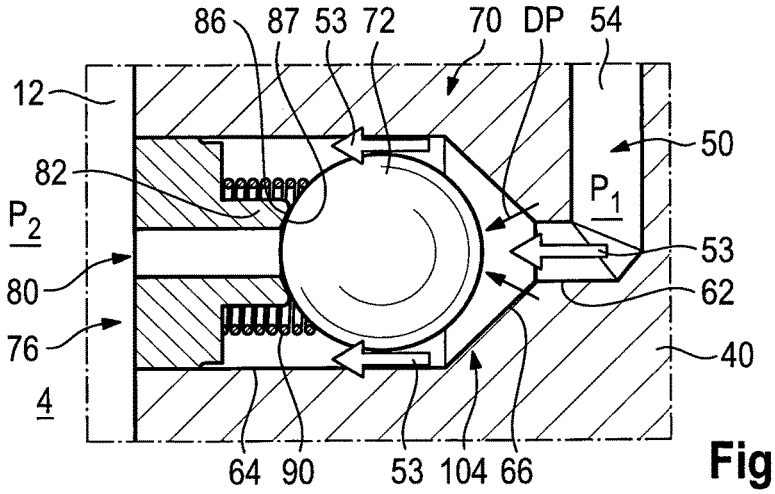
Figure 4:
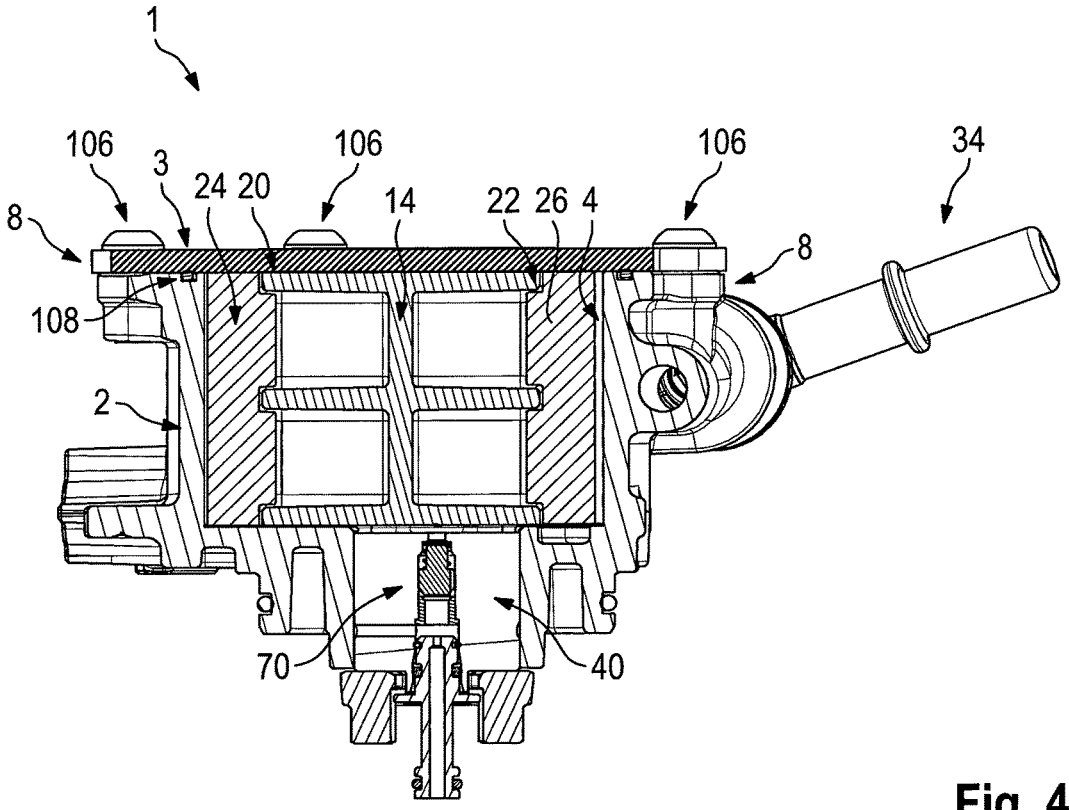
FIG. 4 shows a cross-sectional view of a drive shaft connected to a rotor and a check valve inside the drive shaft according to an embodiment of the invention.
Figure 5A:
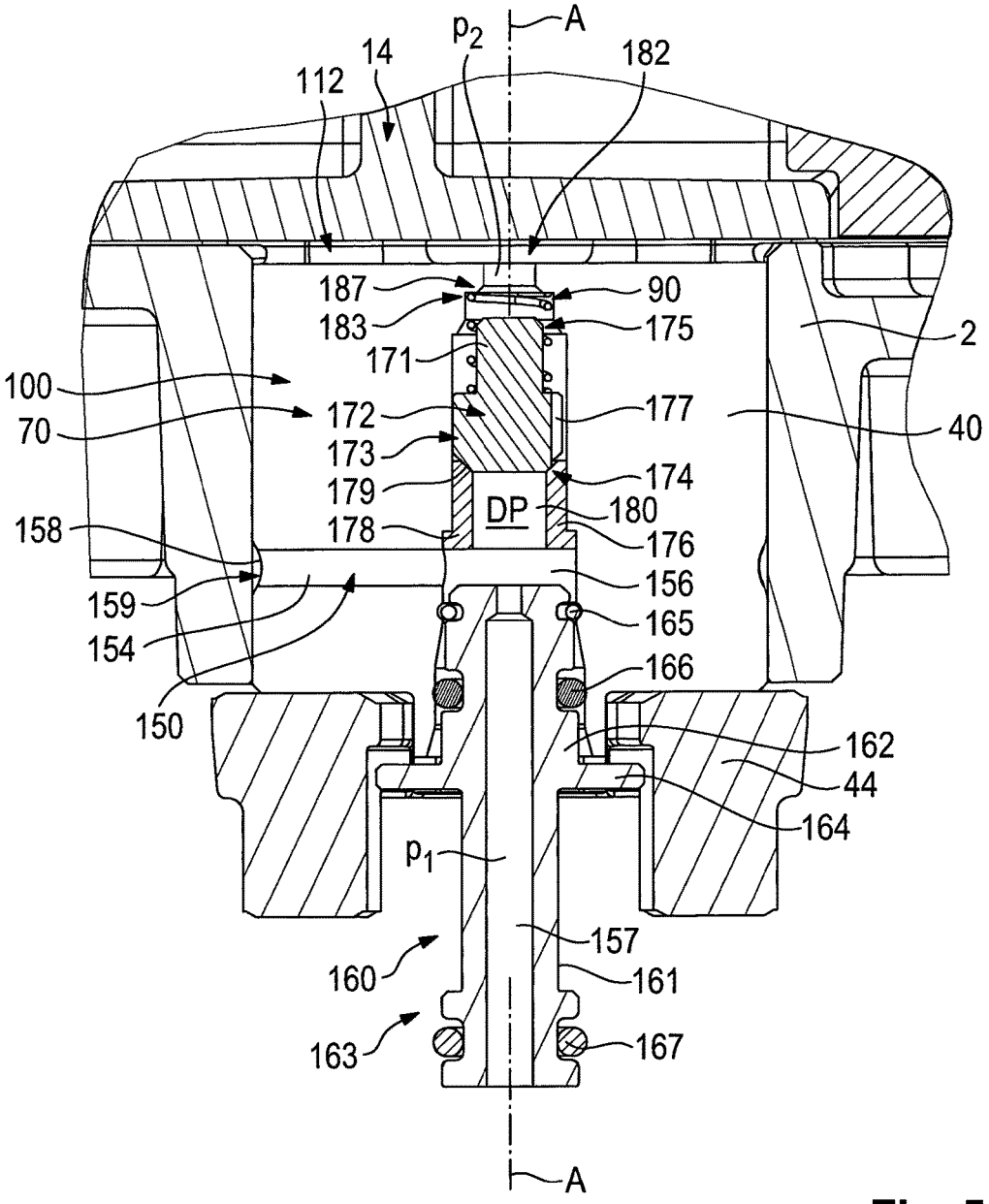
FIGS. 5A-5C show the working principle of the check valve of FIG. 4.
Figure 5B:
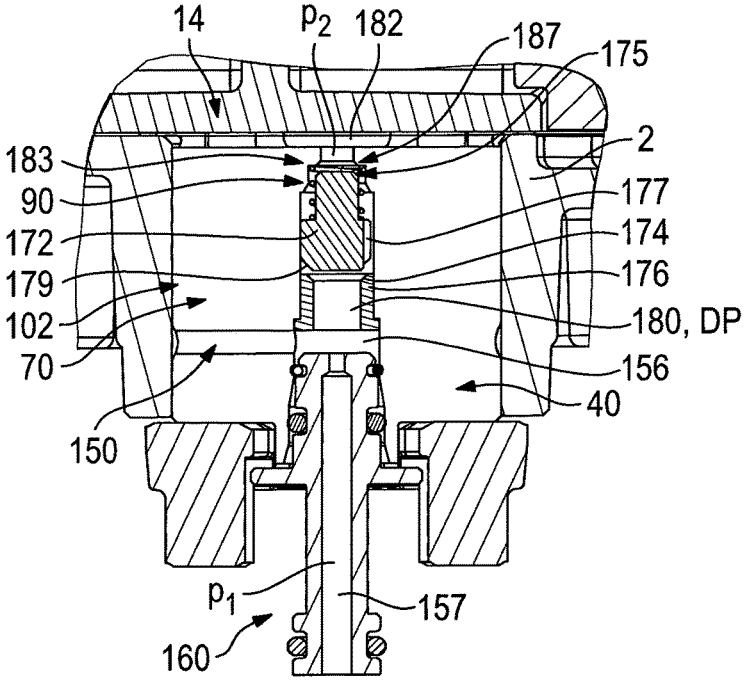
Figure 5C:
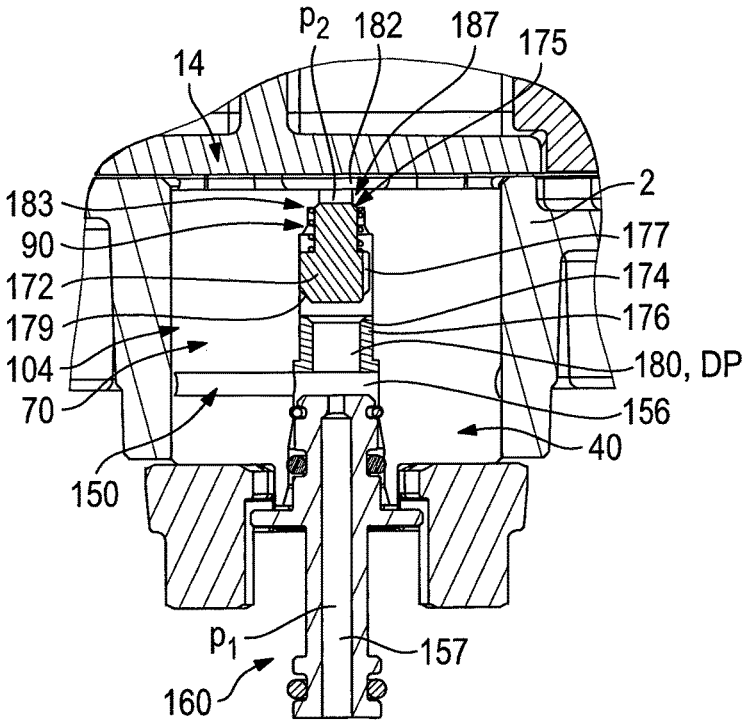

FIG. 4 to 5C illustrate a second embodiment of the vacuum pump 1 comprising the check valve 70 which measures the oil flow to the cavity 4. Identical and similar parts are indicated with identical reference signs. Insofar reference is made to the above description of the first embodiment (FIG. 1-3C).

According to the cross-sectional view of FIG. 4 the vacuum pump 1 comprises a casing 2 having a cavity 4. The casing 2 has a cover plate 3 which was fixed to the casing 2 by means of screws 106. The screws 106 are engaging the cover fixing portions 8, which are integrally formed with the casing 2 (see also FIG. 1). A seal 108 is arranged between the cover plate 3 and the casing 2 inside a groove formed in the casing 2 for an airtight sealing of the cavity 4.

A rotor and a vane 14 are provided within the cavity 4. The rotor cannot be seen in FIG. 4, since the cross-section cutting plane runs through the plane of the vane 14, so that the rotor is hidden behind the vane 14. The vane 14 includes seals 24, 26 arranged radial ends 20, 22 which are provided with seals 24, 26 for sealing the vane against an inner circumferential wall of the cavity 4 (see also FIG. 1). The rotor (which is not shown in FIG. 4) is connected to a shaft 40 in which a check valve 70 is arranged. The shaft 40 and the check valve 70 will be described in greater detail below with reference to FIG. 5A-5C.

FIG. 5A to 5C illustrate three different working positions 100, 102, 104 of the check valve 70, similar to the illustration in FIG. 3A to 3C. FIG. 5A shows the first closed position 100 corresponding to FIG. 3A, FIG. 5B shows the open position 102, corresponding to FIG. 3B and FIG. 5C illustrates the second closed position 104, corresponding to FIG. 3C.

Now with reference to FIG. 5A, the shaft 40 which is seated in a cylindrical portion of the casing 2 is connected via a connection portion 112 with the rotor inside the cavity. The cylindrical portion of the casing 2 in which the shaft 40 is seated, forms a main friction bearing for the shaft 40. Inside the shaft 40 the check valve 70 is provided which is in general formed according to the check valve 70 of the first embodiment (see FIG. 2 to 3C).

The check valve 70 according to the second embodiment (FIG. 4 to 5C) is provided inside an oil supply conduit 150, which includes an axial portion 156 extending along the whole axial length of the shaft 40 along the rotation axis A. The oil supply conduit 150 further comprises a radial portion 154 terminating in a circumferential groove 158 which forms part of an oil gallery 159 for the main friction bearing between the shaft 40 and the casing 2.

Different from the first embodiment (see FIG. 2 to 3C) the oil supply conduit 150 is not fed through the radial portion 154 and the oil gallery 159, but through the axial portion 156 in which at a distal end 44 of the shaft 40 an oil coupling 160 is provided. The oil coupling 160 includes an oil passage 157 which is in fluid communication with the oil supply conduit 150 and forms part of the axial portion 156. The oil coupling 160 has a body 161 having an engagement portion 162 for engaging with the axial portion 156 of the conduit 150 formed in the shaft 40 and a connection portion 163 for connecting the oil coupling 160 to a cam shaft of an engine so that oil may be supplied via the oil coupling 160 to the oil supply conduit 150 and thus to the cavity 4. The oil coupling body 161 includes a radially extending collar 164 which abuts against a portion of the shaft 40 for defining the axial relationship between the shaft 40 and oil coupling 160. Further the body 161 of the oil coupling 160 is provided with seals 165, 166, 167, wherein the seals 165, 166 are pressed against an inner circumferential wall of the axial portion 156 formed inside the distal end 44 of the shaft 40 for sealing the oil coupling 160 against the shaft 40. The seal 167 arranged at the connection portion 163 is adapted for sealing the oil coupling 160 against an oil outlet of a cam shaft (not shown in the FIG.).

The check valve 70 is arranged in the axial portion 156 of the oil supply conduit 150. The check valve 70 includes a check valve body 172 which according to this embodiment (see FIGS. 4 to 5C) is formed as a pintle 172. The pintle 172 is generally shaped in the form of a mushroom and has a stem 171 and a head 173.

A second valve seat 187 is formed as a tapered portion of the circumferential inner wall of the axial portion 156 of the oil supply conduit 150 in the shaft 40. The tapered portion forming the second valve seat 187 encircles an outlet opening 182 of the oil supply conduit 150 leading into the cavity 4. The stem 171 of the pintle 172 includes a tapered portion 175 corresponding to the tapered portion of the second valve seat 187 for engaging the same. Thus, when the pintle 172 is in the first closed position 100 as shown in FIG. 5A the tapered portion 175 is disengaged from the second valve seat 187 and a gap between the second valve seat 187 and the tapered portion 175 is provided. When in contrast the pintle 172 is in the second closed position 104 as shown in FIG. 5C, the tapered portion 175 of the stem 171 engages the second valve seat 187 and thus closes the opening 182 so that oil cannot be provided via the oil supply conduit 150 into the cavity 4.

At the same time the stem 171, which has a substantially cylindrical shape, serves as a guide and holding support for the biasing member 90, which according to this embodiment is formed as a spiral spring. The biasing member 90 is seated about the stem 171 and abuts against the head 173 of the pintle 172 and on the other hand is seated on a inwardly extending collar 183 formed around the opening 182 and the second valve seat 187. Therefore, the second valve seat 187 is arranged between the collar 183 and the opening 182.

Further different to the first embodiment (FIG. 2 to 3C), in which the second valve seat 87 is formed by the plug 76, according to the second embodiment (FIG. 4 to 5C) the first valve seat 174 is formed by the plug 176. The plug 176 according to this embodiment is substantially formed as a cylindrical bushing having a through hole 180 which forms a passage way for the oil and has an inwardly tapered surface forming the first valve seat 174. At the opposite end the plug 176 has a collar 178 which engages a corresponding recess in the inner circumferential surface of the oil supply conduit 150 for defining an axial position of the plug 176 relative to the shaft 40. The plug 176 may be fixed to the shaft 40 by means of a tight fit or by any other suitable fixing means. The plug 176 is adapted to engage with the head 173 of the pintle 172. Therefore the head 173 of the pintle 172 includes a tapered portion 179 which corresponds to the tapered surface of the plug 176 which forms the valve seat 174. According to FIG. 5A in which the check valve 70 is shown in the first closed position 100 the tapered surface 179 engages the first valve seat 174. The biasing member 90 forces the pintle 172 into the first closed position 100, as can be easily seen in FIG. 5A.

The head 173 of the pintle 172 has a substantially cylindrical outer shape. The outer diameter of the head 173 corresponds substantially to the inner circumferential diameter of the portion of the axial portion 156 of the oil supply conduit 150 in which the pintle 172 is located. Thus, the pintle 172 can be guided inside the axial portion 156, when moving between the three positions 100, 102, 104.

For allowing a flow of oil from the oil coupling 160 to the cavity 4 the pintle 172 comprises a groove 177 formed on an outer portion of the head 173. The groove 177 has a radial depth which is smaller than the wall thickness of the plug 176 so that when the pintle 172 engages the first valve seat 174 (FIG. 5A) the axial portion 156 of the oil supply conduit 150 is sealed in a fluid tight manner.

In FIG. 5B the check valve 70 is shown in the open position 102 and in FIG. 5C in the second closed position 104. The working principle of the check valve 70 of the second embodiment is substantially identical to the working principle of the check valve 70 according to the first embodiment (see FIG. 3A to 3C). When no oil is supplied via the oil coupling 160 to the check valve 70 and the vacuum pump 1 is in an idle state, pressure P1 is at a normal value and the pintle 172 is forced to engage the first valve seat 174 by means of the biasing member 90. When oil pressure P1 is increased and oil pressure DP which is the difference between P1 and P2 rises accordingly and exceeds a predetermined threshold, the pintle 172 is moved away from the first valve seat 174 into an open position 102 as shown in FIG. 5B. In the open position 102 the pintle 172 is neither engaging the first valve seat 174 nor the second valve seat 187 and thus oil can be supplied from the oil coupling 160 to the cavity 4 via the oil passage 157, the axial portion 156, the through hole 180 in the plug 176, through the gap between the head 173 and the valve seat 174, the groove 177 then through a gap between the tapered surface 175 and the second valve seat 187 through the opening 182 into the cavity 4. When the oil pressure DP rises further, e.g. because pressure P1 relative to the normal pressure rises or pressure P2 relative to the normal pressure is decreased, the pintle 172 is moved further away from the first valve seat 174 and the biasing member 90 is further compressed so that the tapered surface 175 of the stem 171 engages the second valve seat 187 and oil flow from the oil coupling 160 to the cavity 4 is stopped.

Most significantly in the present embodiment (FIG. 5A to 5C), it can be seen that, when the oil pressure DP exceeds the upper oil pressure threshold and the check valve 70 is in the second closed position 104 as shown in FIG. 5C, oil may only flow through the oil coupling 160 and the conduit 157 to the radial portion 154 and the oil gallery 159 for supplying oil to the main friction bearing between the drive shaft 40 and the casing 2. Thus, oil at the high oil pressure is supplied to the oil gallery 159. This additional oil pressure on the main bearing supplements the hydro-dynamically generated bearing pressure and significantly reduces the low speed power consumption of the vacuum pump 1. The same effect is present at the vacuum pump 1 according to the first embodiment (FIG. 2 to 3C), however the main friction bearing is not shown in FIG. 2 to 3C. The benefits of the described additional oil pressure will be apparent to the person skilled in the art also with respect to first embodiment (FIG. 2 to 3C).

Figure 6:
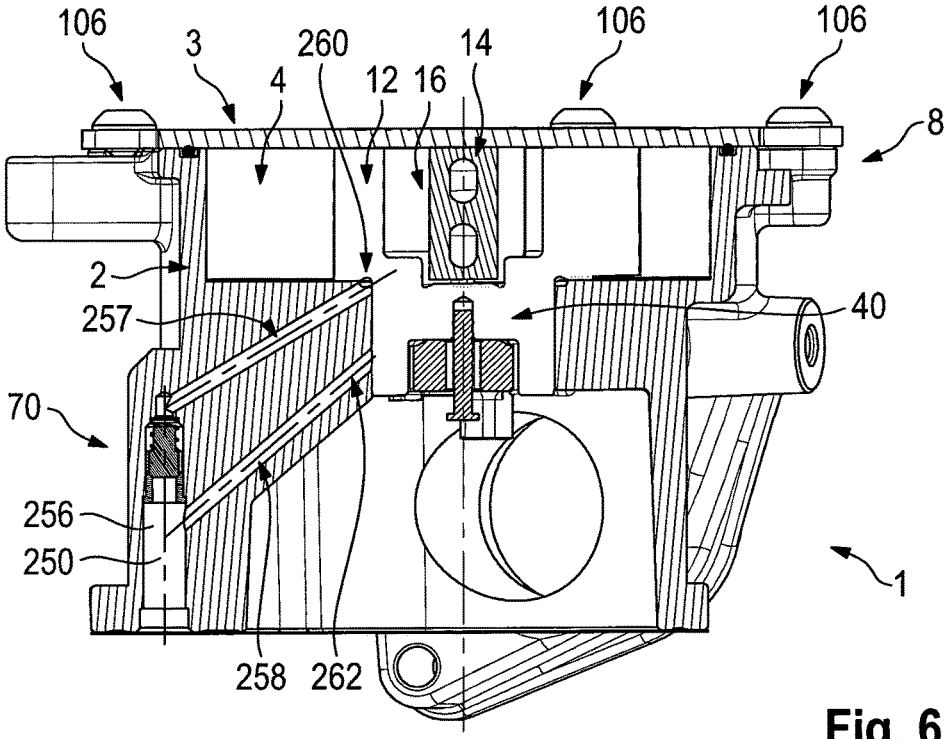
FIG. 6 shows a cross-sectional view of a drive shaft connected to a rotor and a check valve inside the drive shaft according to a third embodiment of the invention.
Figure 7A:
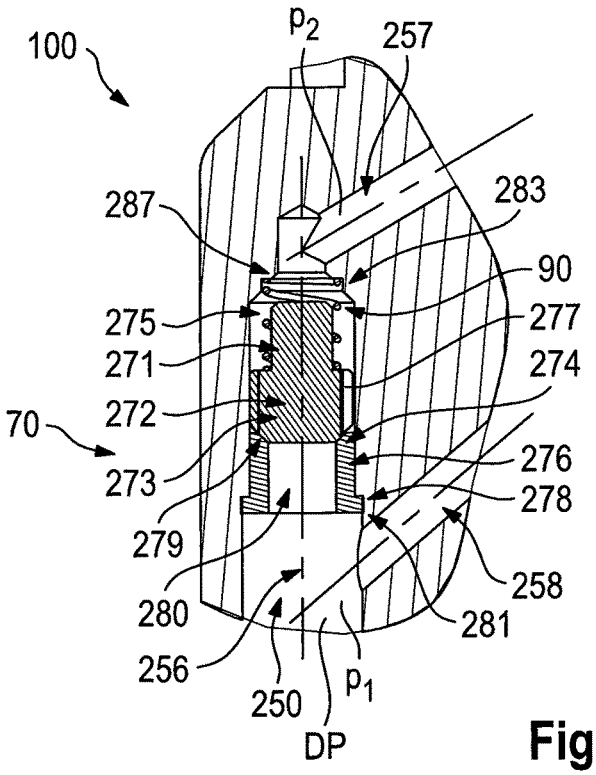
FIG. 7A-7C show the working principle of the check valve of FIG. 6.
Figure 7B:
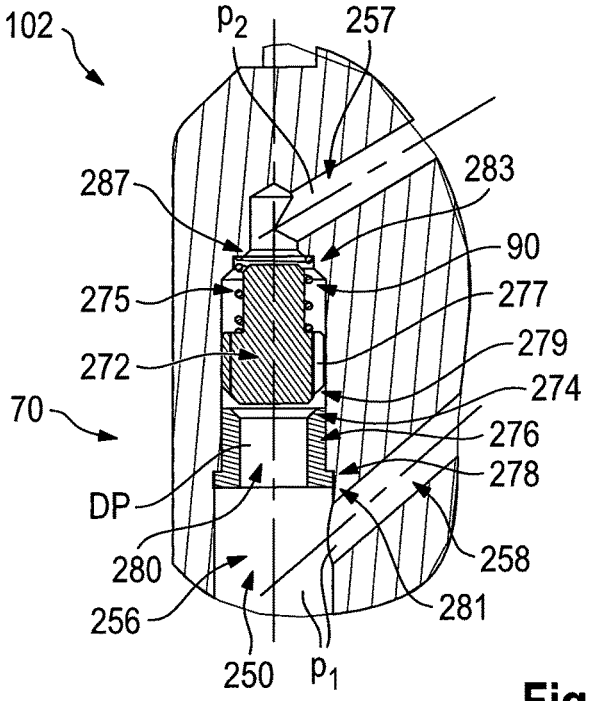
Figure 7C:
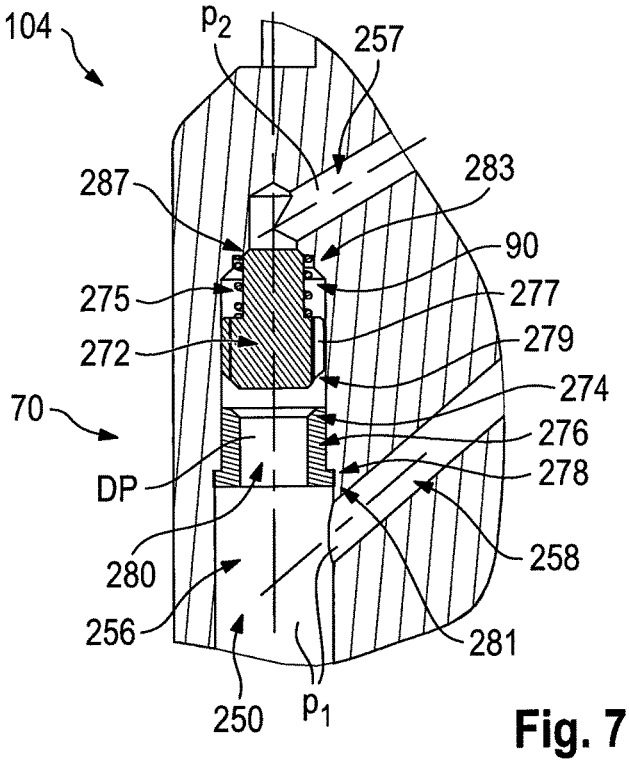

Now referring to FIG. 6 to 7C, a third embodiment of the vacuum pump 1 is shown. Identical and similar parts are shown with identical reference signs. Insofar reference is made to the above description of the first and second embodiments of the vacuum pump.

The vacuum pump 1 of the third embodiment (FIG. 6 to 7C) comprises a casing 2 in which a cavity 4 is formed and a cover 3, which is fixed to the casing 2 by means of screws 106 which engage fixing portions 8 formed in the casing 2. The vacuum pump 1 further includes a rotor 12 and a vane 14 which is arranged in a slot 16 of the rotor 12. The cross-sectional plane of FIG. 6 runs substantially perpendicular to a plane of the vane 14, so that the rotor 12 and parts of the free cavity 4 can be seen in contrast to FIG. 4 above.

The rotor 12 is connected to a drive shaft 40 which is seated in a cylindrical recess of the casing 2 by means of a friction bearing as described above with reference to the second embodiment (FIG. 4 to 5C).

The vacuum pump 1 further includes a check valve 70 which is according to this embodiment (FIG. 6 to 7C) arranged in the casing 2 and not in the shaft 40 as it is in the first and second embodiment (FIG. 2 to 5C). Therefore an oil supply conduit 250 is arranged in the casing 2 which comprises an axial portion 256 and two slanted conduit 257, 258. The first slanted conduit 257 connects the axial portion 256 with an outlet 260 which terminates at the cavity 4 so that oil can supplied via the oil supply conduit 250 to the cavity 4. The second slanted conduit 258 connects the axial portion 256 with an oil gallery 262 at the friction bearing between the shaft 40 and the casing 2.

The check valve 70 will now be described in a greater detail with reference to FIG. 7A to 7C. Again, corresponding to the FIGS. 3A to 3C and 5A to 5C, the check valve 70 is shown in FIG. 7A in a first closed position 100 in FIG. 7B in an open position 102 and in FIG. 7C in a second closed position 104. The structure of the check valve 70 according to the third embodiment (FIG. 6 to 7C) is in general similar to the structure of the check valve 70 of the second embodiment (FIG. 4 to 5C). The check valve 70 of the third embodiment (FIG. 6 to 7C) comprises a check valve body 272 which is formed as a pintle 272 similar to the one of the second embodiment. The pintle 272 again comprises a stem 271 and a head 273.

The axial portion 256 of the oil supply conduit 250 comprises a tapered surface forming the second valve seat 287 and a recess 283. A biasing member 90 which according to this embodiment again is formed as a spiral spring 90 is seated in the recess 283 and engages the stem 271 of the pintle 272. The stem 271 includes similar to the stem 171 (see FIG. 5A) a tapered portion 275 corresponding to the tapered portion 175 for engaging the second valve seat 287.

In the axial portion 256 of the oil supply conduit 250 a plug 276 is arranged. The plug 276 is formed identical to the plug 176 according to the second embodiment. Different from the second embodiment the plug 276 according to the third embodiment is arranged in the axial portion 256 of the oil supply conduit 250 in the casing 2 and not in the shaft 40. The plug 276 is substantially formed as a bushing having a central through hole 280 for allowing oil flow from the axial portion 256 to the slanted conduit 257 of the oil supply conduit 250. The plug 276 includes an inwardly tapered surface forming the first valve seat 274. The head 273 of the pintle 272 includes a tapered portion 279 which corresponds to the tapered portion of the plug 276 forming the first valve seat 274. The plug 276 further includes a collar 278 engaging a recess 281 in the casing 2 to tight fit the plug 276 into the axial portion 256 of the oil supply conduit 250.

Similar to the second embodiment, the head 273 of the pintle 272 includes a groove 277 at an outer circumferential portion thereof to allow oil to flow through the groove 277.

The functionality of the check valve 70 according to the third embodiments (FIG. 6 to 7C) is similar to the first and second embodiments (FIG. 2 to 5C). When the vacuum pump 1 is in an idle state, the biasing member 90 forces the pintle 272 against the first valve seat 274 formed by the plug 276. Since the tapered portion 279 of the head 273 engages the first valve seat 274, no oil can flow from the axial portion 256 to the slanted conduit 257 and thus no oil can flow into the cavity 4. Only oil supply from the oil supply conduit 250 to the slanted conduit 258 and thus to the oil gallery 262 for the friction bearing of the shaft 40 is allowed. When the pressure DP, which is the difference between pressure P1 and pressure P2 in the axial portion 256 rises, the pintle 272 is moved away from the first valve seat 274 into the direction of the second valve seat 287 and oil flow from the axial portion 256 to the slanted conduit 257 and thus to the cavity 4 is established. The oil flows from the axial portion through the through hole 280 in the plug 276 then between the tapered portion forming the valve seat 274 and tapered portion 279 of the head 273 through the groove 277 along the stem 271, then between the tapered portion 275 of the stem 271 and the tapered portion of the casing forming the second valve seat 287 and into the slanted conduit 257 of the oil supply conduit 250 and finally into the cavity 4. In case the oil pressure DP rises further and exceeds a predetermined threshold, the pintle 272 is further moved into the direction of the second valve seat 287 and engages the second valve seat with the tapered portion 275 of the stem 271 and the oil flow from the axial portion 256 into the slanted conduit 257 and thus into the cavity 4 is stopped accordingly.

When the check valve 70 according to the third embodiment (FIG. 6 to 7C) is in the second closed position 104 the the oil reservoir pressure may directly by applied to the oil gallery 262 and thus to the main friction bearing of the vacuum pump 1 formed between the drive shaft 40 and the casing 2 via the slanted conduit 258. This additional oil pressure on the main bearing supplements the hydro-dynamically generated bearing pressure and significantly reduces the low speed power consumption of the vacuum pump 1, as already described above with reference to the second embodiment (FIG. 5A to 5C).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCES

1 vacuum pump
2 casing
3 cover plate
4 cavity
6 rim
8 cover fixing portion
10 engine fixing portion
12 rotor
14 moveable member/vane
16 slot
18 arrow
20, 22 ends of vane
24, 26 seal of vane
28 wall
30 first bypass port
31 inlet
32 second bypass port
33 outlet
34 connector
40 shaft
42 proximal end
44 distal end
46 engagement section
50 oil supply conduit
52 arrow (direction of the oil flow in open position)
53 arrow (oil flow in closed position)
54 radial portion
56 axial portion
58 circumferential groove forming a part of an oil gallery
60 inlet of oil supply conduit
62 distal portion
64 diameter enlarged portion
66 tapered portion
70 check valve
72 check valve body/ball
74 first valve seat
76 plug
78 plug body
80 through hole
82 protrusion
84 top end
86 inwardly sloped surface
87 second valve seat
88 surface
90 biasing member/spiral spring
92 gap
100 first closed position
102 open position
104 second closed position
106 screw
108 seal
112 connection portion
150 oil supply conduit
154 radial portion
156 axial portion
157 oil passage
158 circumferential groove
159 oil gallery
160 oil coupling
161 body of oil coupling
162 engagement portion
163 connecting portion
164 outwardly extending collar
165 seal
166 seal
167 seal
171 stem
172 check valve body/pintle
173 head
174 first valve seat
175 tapered portion
176 plug
177 groove
178 collar of the plug
179 tapered portion of the pintle
180 through hole
182 outlet opening
183 inwardly extending collar
187 second valve seat
250 oil supply conduit
256 axial portion
257, slanted conduit
258 slanted conduit
260 outlet
262 oil gallery
271 stem
272 check valve body/pintle
273 head

274 first valve seat
275 tapered portion of the stem
276 plug
277 groove
278 collar
279 tapered portion
280 central through hole
283 recess
287 second valve seat
A rotation axis of the shaft
P1 oil pressure on the oil gallery side of the check valve
P2 oil pressure on the cavity side of the check valve
DP oil pressure acting on check valve (DP=P1−P2)

The invention claimed is:

1. A vacuum pump suitable for mounting to an engine, comprising:
a casing;
a cavity in the casing, the cavity having an inlet and an outlet;
a vane configured to be rotated inside the cavity so as to draw fluid into the cavity through the inlet and to expel fluid out of the cavity through the outlet thereby causing a reduction in pressure at the inlet;
an oil supply conduit configured to supply oil from a reservoir to the cavity; and
a check valve arranged in the oil supply conduit between the reservoir and the cavity, the check valve having a check valve body,
wherein the check valve is configured to meter a flow of the oil from the reservoir to the cavity, and
wherein the check valve body is configured to be located, when a pressure in the oil supply conduit on a reservoir side of the check valve exceeds, by at least a first threshold, a pressure in the oil supply conduit on a cavity side of the check valve, in a closed position thereby preventing the flow of oil from the reservoir to the cavity.

2. The vacuum pump as claimed in claim 1, wherein the check valve is further configured to prevent the flow of oil to the cavity when the pressure in the oil supply conduit on the reservoir side of the check valve is less than a second threshold.

3. The vacuum pump as claimed in claim 1, wherein the check valve body is configured to be moved between a first closed position, an open position, and a second closed position, the second closed position being the closed position in which the check valve body is configured to be located when the pressure in the oil supply conduit on the reservoir side of the check valve exceeds, by at least the first threshold, the pressure in the oil supply conduit on the cavity side of the check valve,
wherein the check valve body is configured to be located in the first closed position when the pressure in the oil supply conduit on the reservoir side of the check valve is less than a second threshold, and
wherein the check valve body is configured to be located in the open position when the pressure in the oil supply conduit on the reservoir side of the check valve is not less than the second threshold and does not exceed the pressure in the oil supply conduit on the cavity side of the check valve by the first threshold or more.

4. The vacuum pump as claimed in claim 3, wherein a biasing member is arranged in the check valve, the biasing member being configured to bias the check valve body in the first closed position.

5. The vacuum pump as claimed in claim 4, wherein the biasing member is a spring supported on the cavity side of the check valve.

6. The vacuum pump as claimed in claim 1, wherein the check valve comprises a first valve seat and a second valve seat, each of the first valve seat and the second valve seat being configured to engage with the check valve body.

7. The vacuum pump as claimed in claim 6, wherein the second valve seat is arranged on the cavity side of the check valve and the first valve seat is arranged on the reservoir side of the check valve.

8. The vacuum pump as claimed in claim 6, wherein at least one of the two valve seats is formed by a plug having a through hole and arranged in the oil supply conduit.

9. The vacuum pump as claimed in claim 5, wherein the through hole connects the oil supply conduit with the cavity.

10. The vacuum pump as claimed in claim 1, further comprising a drive shaft configured to rotationally drive the vane, wherein the oil supply conduit extends through the drive shaft.

11. The vacuum pump as claimed in claim 10, wherein the oil supply conduit comprises an axial portion extending parallel to an axis of rotation of the drive shaft.

12. The vacuum pump as claimed in claim 11, wherein the oil supply conduit comprises a radial portion extending from a circumferential face of the drive shaft to the rotational axis of the drive shaft and in fluid communication with the axial portion of the oil supply conduit.

13. The vacuum pump as claimed in claim 11, wherein the check valve is arranged in the axial portion of the oil supply conduit.

14. The vacuum pump as claimed in claim 11, wherein the oil supply conduit further comprises a radial portion in fluid communication with an oil gallery.

15. The vacuum pump as claimed in claim 1, further comprising a spring configured to bias the check valve body towards the reservoir side of the check valve against a first valve seat.

16. The vacuum pump as claimed in claim 15, further comprising a second valve seat against which the check valve body is biased when in the closed position in which the check valve body is configured to be located when the pressure in the oil supply conduit on the reservoir side of the check valve exceeds, by at least the first threshold, the pressure in the oil supply conduit on the cavity side of the check valve.

17. A system, comprising:
an engine; and
a vacuum pump including:
a casing;
a cavity in the casing, the cavity having an inlet and an outlet;
a vane configured to be rotated inside the cavity so as to draw fluid into the cavity through the inlet and to expel fluid out of the cavity through the outlet thereby causing a reduction in pressure at the inlet;
a drive shaft configured to rotationally drive the vane;
an oil supply conduit extending through the drive shaft and configured to supply oil from a reservoir to the cavity; and
a check valve arranged in the oil supply conduit between the reservoir and the cavity, the check valve having a check valve body,
wherein the check valve is configured to meter a flow of the oil from the reservoir to the cavity, and
wherein the check valve body is configured to be located, when a pressure in the oil supply conduit on a reservoir side of the check valve exceeds, by at least a first threshold, a pressure in the oil supply conduit on a cavity side of the check valve, in a closed position thereby preventing the flow of oil from the reservoir to the cavity, and wherein the vacuum pump is mounted to the engine.

18. The system of claim 17, wherein the vacuum pump is driven by a camshaft of the engine.

19. The system of claim 18, wherein the engine is an engine of a road vehicle.

20. A vacuum pump suitable for mounting to an engine, comprising:

a casing;

a cavity in the casing, the cavity having an inlet and an outlet;

a vane configured to be rotated inside the cavity so as to draw fluid into the cavity through the inlet and to expel fluid out of the cavity through the outlet thereby causing a reduction in pressure at the inlet;

an oil supply conduit configured to supply oil from a reservoir to the cavity;

a check valve arranged in the oil supply conduit between the reservoir and the cavity, the check valve having a check valve body; and valve seat against which the check valve body is biased so as to prevent the flow of oil from the reservoir to the cavity when a pressure in the oil supply conduit on a reservoir side of the check valve exceeds, by at least a first threshold, a pressure in the oil supply conduit on a cavity side of the check valve.

* * * * *